United States Patent [19]

Kusche

[11] 4,333,425

[45] Jun. 8, 1982

[54] FUEL SYSTEM FOR A TWO-CYCLE ENGINE

[75] Inventor: David W. Kusche, Oshkosh, Wis.

[73] Assignee: Brunswick Corporation, Skokie, Ill.

[21] Appl. No.: 220,386

[22] Filed: Dec. 29, 1980

[51] Int. Cl.[3] ..... F02B 33/04

[52] U.S. Cl. ..... 123/73 R; 123/73 A; 123/73 C; 123/73 CC; 123/73 PP

[58] Field of Search ..... 123/73 R, 73 A, 73 V, 123/73 PP, 74 R, 73 C, 73 CC, 73 SP

[56] References Cited

U.S. PATENT DOCUMENTS

| | | | |
|---|---|---|---|
| 2,759,716 | 8/1956 | Jones | 123/73 R |
| 2,959,164 | 11/1960 | Janeway et al. | 123/73 A |
| 3,132,635 | 5/1964 | Heidner | 123/73 A |
| 3,195,524 | 7/1965 | Heidner | 123/73 A |
| 3,472,211 | 10/1969 | Meininger | 123/73 R |
| 3,690,304 | 9/1972 | Schneider et al. | 123/73 A |
| 3,916,851 | 11/1975 | Otani | 123/73 A |
| 4,228,770 | 10/1980 | Boyesen | 123/73 R |
| 4,284,040 | 9/1981 | Baltz et al. | 123/73 A X |
| 4,286,553 | 8/1981 | Baltz et al. | 123/73 A X |

*Primary Examiner*—Wendell E. Burns
*Attorney, Agent, or Firm*—O. T. Sessions

[57] ABSTRACT

A two-cycle engine (10) has an idle fuel system which admits fuel-air mixture into the transfer passages (22). Heated air is supplied to the idle mixing passage (42) by a serpentine air passage (45), while fuel from the carburetor float bowl (33) is supplied through a needle valve (50). A reed valve (43) admits the idle mixture to the transfer passage (22).

10 Claims, 3 Drawing Figures

FUEL SYSTEM FOR A TWO-CYCLE ENGINE

DESCRIPTION

1. Technical Field

This invention relates to internal combustion engines and particularly to fuel systems for two-cycle engines.

2. Background Art

Rough or uneven idle operation can occur in two-cycle engines as a result of the accumulation of liquid fuel oil mixture in the crankcase. The problem is aggravated by modern engine designs which use external reed blocks providing high volumes of air flow to obtain the desired performance. One approach to this problem includes systems for removing the condensed fuel from the crankcase such as those disclosed in U.S. Pat. Nos. 3,929,111 to Turner et al, 3,859,967 to Turner et al, 3,730,149 to Brown, and 3,269,374 to Conover. Another approach is engine cooling systems which use cooling water to warm the crankcase at idle speeds, such as those disclosed in U.S. Pat. Nos. 4,082,068 to Hale, 3,939,807 to Eichinger, and 3,918,418 to Horn. Yet another approach is the use of modified idle fuel feeding systems, such as those disclosed in U.S. Pat. Nos. 3,361,120 to Schneider and 3,453,994 to Nutten, et al.

U.S. Pat. No. 2,388,331 to Kincannon shows a fuel system for an older type outboard motor engine having a rotary valve for admitting air fuel mixture to the crankcase. This fuel system included a separate idle mixture passage for providing a heated air fuel mixture through a piston controlled port to the crankcase.

DISCLOSURE OF INVENTION

A fuel system for a two-cycle, crankcase compression engine is disclosed. The engine has a reciprocating piston mounted in a cylinder with a closed crankcase on one end of the cylinder. An exhaust port is provided to remove combustion gases from the cylinder. The fuel system includes a main inlet passage for supplying an air-fuel mixture to the crankcase, a main valve for shutting off the main inlet passage at idle speeds, and an idle inlet passage for supplying an idle air-fuel mixture directly to the transfer passage. Preferrably the idle inlet passage includes a one way valve to admit the idle air-fuel mixture to the transfer passage. Provisions can be made to heat the idle mixture before it is admitted to the transfer passage.

In the preferred embodiment a carburetor mounted on the crankcase includes a fuel reservoir, a main inlet passage for mixing air with fuel from the reservoir and supplying the mixture to the crankcase, and the main valve for shutting off the main inlet passage at idle speeds. Fuel from the carburetor reservoir is mixed with heated air in the idle inlet passage and the mixture is supplied to the crankcase for idle operation. Preferably the air is heated by heat from the engine exhaust before mixing with fuel.

BEST MODE FOR CARRYING OUT THE INVENTION

Figure 1:
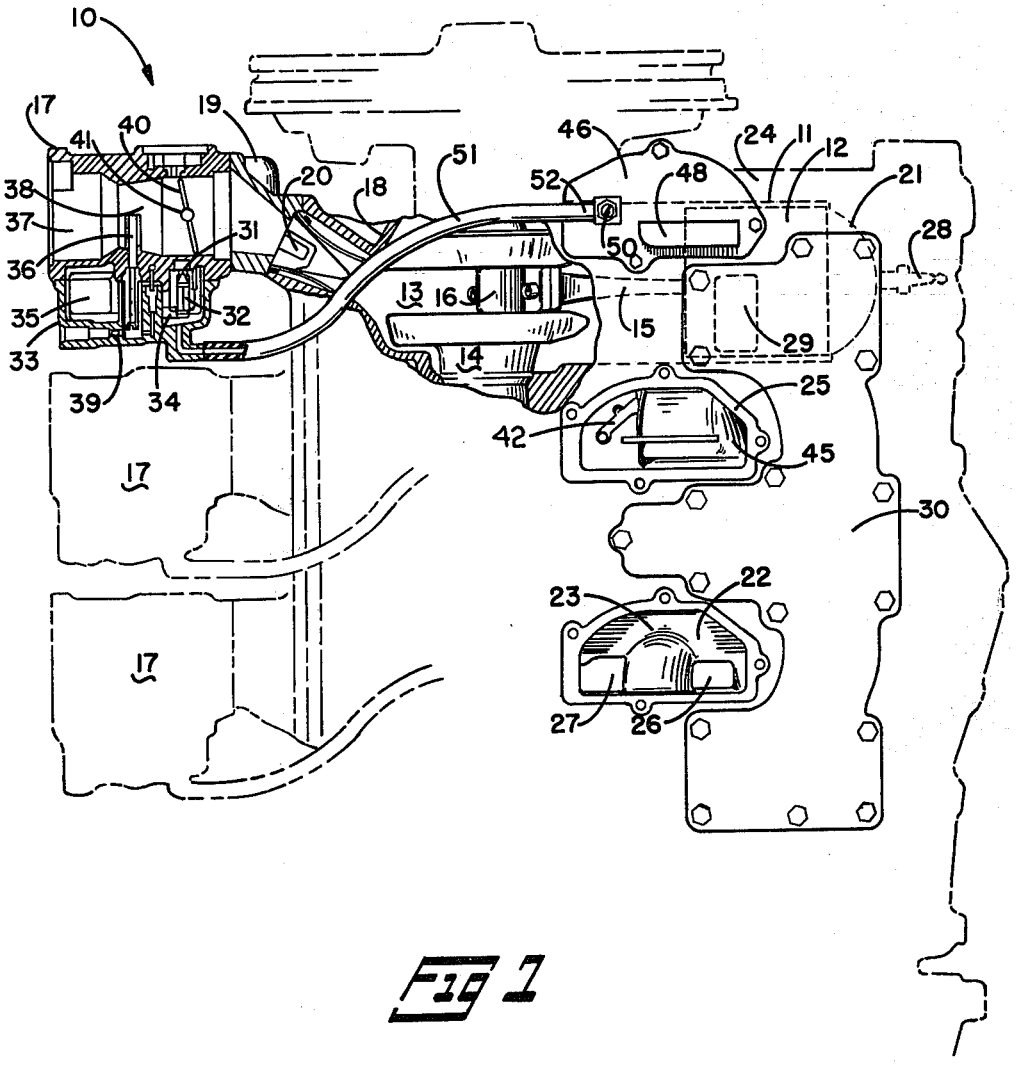
FIG. 1 is a partial sectional view of a three cylinder engine showing details of the fuel system as applied to the upper cylinder according to the invention.
Figure 2:
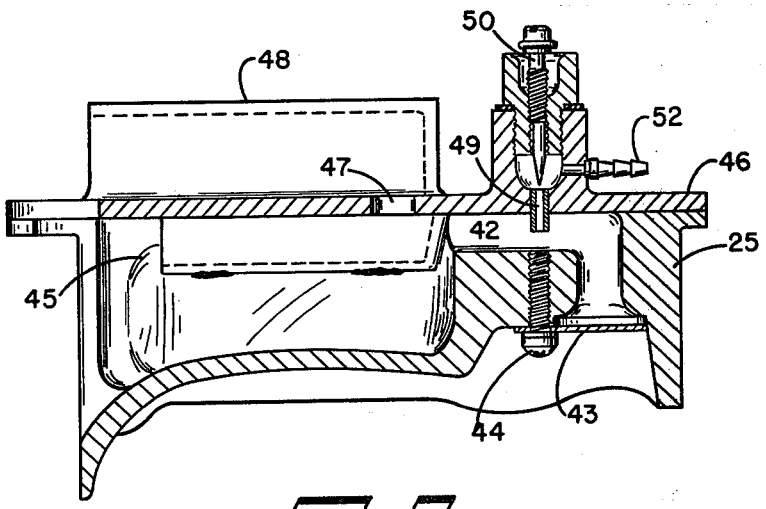
FIG. 2 is a sectional view of one of the transfer port covers showing details of the idle inlet passage.
Figure 3:
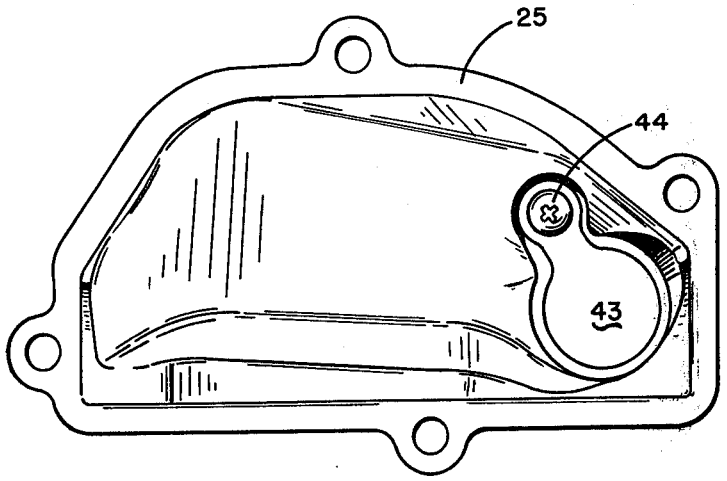
FIG. 3 is a view of the inside of the transfer port cover showing the reed valve for the idle inlet passage.

Referring to the drawings and particularly to FIG. 1, a two-cycle, three cylinder, outboard motor engine 10 incorporating the fuel ystem of the invention is illustrated. The engine 10 is more fully described in the copending application of Hale, entitled "Internal Combustion Engine with Die-Castable Loop Transfer System", Ser. No. 211,436 and in my application Ser. No. 211,380, entitled "Exhaust System For Three Cylinder Two-Cycle Engines", both filed on Nov. 28, 1980. The engine 10 will be described here only to the extent necessary to describe the present invention.

The engine 10 has three cylinders 11 arranged in a vertical bank with a piston 12 mounted for reciprocation in each cylinder 11. A closed crankcase compartment 13 is defined for each cylinder 11 and a crankshaft 14 is mounted for rotation in the compartments 13. Each piston 12 is connected by a connecting rod 15 to a crank pin 16 of the crankshaft 14. Three carburetors 17 are mounted on the crankcase 18 by an inlet manifold 19 to supply the main fuel-air mixture to the respective crankcase compartments 13. The air-fuel mixture is drawn through one-way reed valves 20 into the crankcase compartment 13 as the piston 12 moves toward the cylinder head 21.

Transfer passages 22 are provided around each cylinder 11 to provide a loop charging flow. In the particular engine illustrated, only the transfer passage 22 on the exhaust side of the engine 10 is shown. The transfer passage 22 is formed by a cavity 23 cast in the block 24 and a transfer passage cover 25. In FIG. 1, the lower cylinder 11 is shown with the transfer passage cover 25 removed to make the transfer port 26 and transfer inlet opening 27 visible. The center cylinder 11 is shown with the transfer passage cover 25 in place. The transfer passage 22 thus formed serves to transfer the air-fuel mixture from the crankcase compartment 13 to the cylinder 11 as the piston 12 moves towards the crankcase 13 and uncovers the transfer port 26. The mixture is ignited by a spark plug 28 as the piston 12 nears the cylinder head 21, driving the piston 12 down in the power stroke, and the exhaust gases are discharged through the exhaust port 29 in the cylinder wall as the port 29 is uncovered by the piston 12. From the exhaust port 29 the exhaust gases enter an exhaust manifold 30 and are subsequently discharged from the engine 10.

The three identical carburetors 17 are the float bowl type and receive a fuel-oil mixture from a fuel pump, not illustrated, through the float bowl inlet 31 immediately above the needle valve 32. The level of fuel in the float bowl 33 is maintained at a constant level by a needle inlet valve 32 which is opened by a lever 34 connected to the float 35 to admit fuel whenever the fuel level drops below the desired level.

The carburetor 17 includes a main fuel discharge tube 36 which opens into the carburetor mixing passage 37 at the throat 38. A main jet or orifice 39 admits fuel from the float bowl 33 to the main discharge tube 36. A throttle valve 40 mounted on a throttle shaft 41 downstream of the main discharge tube 36 permits operator control of the air-fuel mixture admitted to the engine 10. Air drawn through the main carburetor mixing passage 37 by suction from the crankcase compartment 13, when the operator controlled throttle valve 40 is opened, causes a reduced pressure at the carburetor throat 38 which draws fuel from the float bowl 33 through the main discharge tube 36 to mix with the air flowing in the mixing passage 37. When the throttle valve 40 is closed, no air-fuel mixture flows through the main carburetor mixing passage 37 to the engine 10.

Separate provision is made for supply an idle air-fuel mixture to the engine 10 for engine idling when the throttle valve 40 is closed. The idle mixture is supplied to the engine 10 through the transfer passage covers 25. To accomplish this each of the transfer covers 25 include an idle mixing passage 42 in communication with the transfer passage 22 through a reed valve 43. The spring steel reed valve 43 is mounted on the inside of the transfer cover 25 by a screw 44 and opens when pressure is sufficiently reduced in the transfer passage 22. Air is admitted to the idle mixing passage 42 through a serpentine passage 45 formed by the mixing passage cover 46 and the transfer cover 25. An air inlet opening 47 through the mixing passage cover 46 admits air to the serpentine passage 45, and an air inlet cover 48 serves to extend the air path and reduce the noise from the air inlet opening 47. The serpentine air passage 45 and air inlet cover 48, due to their position adjacent the exhaust manifold 30 and exhaust port 29, provide heat to the incoming idle air sufficient to provide a temperature rise to the idle air of approximately 45 Fahrenheit degrees.

Fuel from the carburetor float bowl 33 is admitted to the idle mixing passage 42 by an idle fuel passage 49 through the mixing passage cover 46. A needle valve 50 mounted on the mixing passage cover 46 serves to regulate the richness of the idle mixture. A fuel line 51 is connected to the bottom of the carburetor float bowl 33 and to the needle valve inlet 52 to supply fuel from the float bowl 33 to the idle mixing passage 42. The idle fuel passage 49 is positioned higher than the fuel level in the float bowl 33 to prevent fuel flow to the transfer passage 22 when the engine 10 is not operating.

For idle operation, the throttle valve 40 is closed, shutting off flow through the main mixing passage 37 and the engine 10 is supplied with air-fuel mixture solely through the idle mixing passage 42 in the transfer port cover 25. Reduced pressure in the crankcase compartment 13 will cause the reed valve 43 on the transfer cover 25 to open and admit air-fuel mixture to the transfer passage 22. The air entering the air passage 45 will be heated as it flows through the passage and the reduced pressure in the idle mixing passage 42 will draw in fuel through the idle fuel passage 49 to mix with the heated air. The addition of heat to the air before mixing with fuel results in a better mixing, and the heated mixture substantially reduces the problems caused by mixture condensing in the crankcase. Further, the separate idle inlet passages upstream of the idle reed valve 43 have a reduced surface area as compared to the main inlet passages upstream of the main reed valves 20 thus reducing the effects of mixture condensation upstream of the inlet reed valves.

As the throttle valve 40 is opened for normal and high speed operation, the idle mixing passage continues to supply mixture to the engine 10, but as engine speed increases the proportion of heated idle mixture to the main mixture supplied by the carburetors 17 becomes insignificant. Thus the effect of the heated idle mixture on engine efficiency at normal and high speeds is insignificant.

I claim:

1. A fuel system for a two-cycle, crankcase compression engine having a cylinder block, a cylinder, a piston reciprocable in said cylinder, a crankcase, a transfer passage for transferring air-fuel mixture from said crankcase to said cylinder and an exhaust port for removing combustion gases from said cylinder, said fuel system comprising:

(A) a main inlet passage for supplying an air-fuel mixture to said crankcase;

(B) a main valve for shutting off said main inlet passage at idle speeds; and (C) an idle inlet passage for supplying an idle air-fuel mixture directly to said transfer passage.

2. The fuel system defined in claim 1 wherein said idle inlet passage includes a one way valve to admit said idle air-fuel mixture to said transfer passage.

3. A fuel system for a two-cycle, crankcase compression engine having a cylinder block, a cylinder, a piston reciprocable in said cylinder, a crankcase, and a transfer passage for transferring air-fuel mixture from said crankcase to said cylinder, said fuel system comprising:

(A) a main inlet passage for supplying an air-fuel mixture to said crankcase;

(B) a main valve for closing said main inlet passage at idle speeds;

(C) an idle inlet passage for supplying a heated idle air-fuel mixture directly to said transfer passage; and (D) a one way valve for admitting said idle mixture to said crankcase.

4. A fuel system for a two-cycle, crankcase compression engine having a cylinder block, a cylinder, a piston reciprocable in said cylinder, a crankcase, a transfer passage for transferring air-fuel mixture from said crankcase to said cylinder, and an exhaust port for removing combustion gases from said cylinder, and an exhaust port for removing combustion gases from said cylinder, said fuel system comprising:

(A) a carburetor mounted on said crankcase, said carburetor including:

(1) a fuel reservoir, (2) a main inlet passage for mixing air with fuel from said reservoir and supplying the main air-fuel mixture to said crankcase, and (3) a main valve for shutting off said main inlet passage at idle speeds; and (B) an idle inlet passage for mixing heated air with fuel from said reservoir and supplying the resulting heated air-fuel mixture to said crankcase for engine idling operation.

5. The fuel system defined in claim 4 wherein said engine includes a main reed valve for supplying the air-fuel mixture from said main inlet passage to said crankcase.

6. The fuel system defined in claim 5 wherein said engine includes an idle reed valve for supplying said heated air-fuel mixture to said crankcase.

7. The fuel system defined in claim 2, 3, or 6 wherein said idle inlet passage includes an air passage and a fuel passage to supply fuel for mixing with the air in said air passage.

8. The fuel system defined in claim 7 wherein said air passage includes a wall heated by said engine whereby said idle air-fuel mixture is heated.

9. The fuel system defined in claim 8 wherein said heated wall is upstream of said fuel passage whereby the air in said air passage is heated before mixing with fuel.

10. The fuel system defined in claim 9 wherein said idle inlet passage is adjacent said exhaust port.

* * * * *